US007118002B2

(12) United States Patent
Saito et al.

(10) Patent No.: US 7,118,002 B2
(45) **Date of Patent: *Oct. 10, 2006**

(54) PINCH GRIP TYPE BOTTLE-SHAPED CONTAINER

(75) Inventors: Hiromichi Saito, Koto-ku (JP); Takao Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/495,978

(22) PCT Filed: Nov. 25, 2002

(86) PCT No.: PCT/JP02/12278

§ 371 (c)(1),
(2), (4) Date: Oct. 21, 2004

(87) PCT Pub. No.: WO03/045791

PCT Pub. Date: Jun. 5, 2003

(65) Prior Publication Data

US 2005/0040133 A1 Feb. 24, 2005

(30) Foreign Application Priority Data

Nov. 29, 2001 (JP) ..... 2001-364523

(51) Int. Cl.
*B65D 23/10* (2006.01)

(52) U.S. Cl. ..... 215/384; 215/381; 215/398; 220/771

(58) Field of Classification Search ..... 215/279, 215/381, 383, 384; 220/666, 669, 771
See application file for complete search history.

(56) References Cited

U.S. PATENT DOCUMENTS

| | | | | |
|---|---|---|---|---|
| 3,225,950 | A * | 12/1965 | Josephsen et al. | 215/384 |
| D281,577 | S * | 12/1985 | Larson et al. | D9/540 |
| 5,156,285 | A * | 10/1992 | Zogg et al. | 215/384 |
| 5,224,614 | A * | 7/1993 | Bono et al. | 215/384 |
| 5,226,550 | A | 7/1993 | Mikolaitis et al. | |
| 5,392,937 | A | 2/1995 | Prevot et al. | |
| 5,472,105 | A | 12/1995 | Krishnakumar et al. | |
| 6,029,837 | A | 2/2000 | Slat et al. | |
| 6,164,474 | A | 12/2000 | Cheng et al. | |
| 6,564,959 | B1 * | 5/2003 | Saito et al. | 215/384 |

FOREIGN PATENT DOCUMENTS

| | | |
|---|---|---|
| EP | 0 356 829 A1 | 3/1990 |
| EP | 1 431 190 A1 | 6/2004 |
| JP | U 56-97209 | 8/1981 |
| JP | U 04-10009 | 1/1992 |
| JP | A 09-188316 | 7/1997 |
| JP | A 2002-225831 | 8/2002 |
| WO | WO 94/13543 | 6/1994 |

* cited by examiner

*Primary Examiner*—Sue A. Weaver
(74) *Attorney, Agent, or Firm*—Oliff & Berridge, PLC

(57) ABSTRACT

A pinch grip type bottle-shaped container (10) has opposed finger-receiving recesses (11) at sidewall regions of a container main body part, respectively, to thereby form a grip part (G) of the container (10), by the entire region including the recesses and a back surface region of the body part between the recesses. The container according to the invention is provided, at bottom surfaces of the recesses that can be touched and held (11), with multiple projections (14) projecting inwardly or outwardly of the container, thereby improving mold-releasability after the molding process.

1 Claim, 4 Drawing Sheets

PINCH GRIP TYPE BOTTLE-SHAPED CONTAINER

BACKGROUND ART

1. Technical Field

The present invention relates to a bottle-shaped container, i.e., a so-called pinch grip type bottle-shaped container wherein the body part of the container main body is dividedly formed with finger-receiving recesses that can be used as a grip part for gripping the container.

2. Related Art

Synthetic resin containers as represented by PET bottles are light in weight, easy to handle, and have transparency to exhibit a refined appearances comparable to glass containers, besides that they can be manufactured at low cost. Thus, such containers are widely used as containers for filling therein foods, beverages, cosmetics, medicines or the like.

There is a recent tendency to demand for reduction of the resin amount to be used per one container, from the standpoint of effective utilization of resources and reduction in amount of wastes. To cope with such a demand, there are used pinch grip type bottle-shaped containers wherein the body part of the container itself is gripped for pouring the contents. Particularly, pinch grip type bottle-shaped containers have been widely used in case of large-sized containers with a filling volume of 2.7 liters or more for containing therein Japanese "sake", soy sauce, edible oil, Japanese "shochu" (distilled spirit), and whisky.

It is conventional practice to mold a bottle-shaped container made of synthetic resin, by blow molding process, and particularly by biaxial-stretching blow molding process. However, in the case of a pinch grip type bottle-shaped container, the container is provided, at its sidewall regions of the container main body part, with opposed recesses that can be touched and held by fingers or fingertips for enabling users to readily grip the body part of the container. As such, there are instances wherein the container after the molding process cannot be readily released from the mold such recesses. Therefore, it would be desirable to further improve the pinch grip type bottle-shaped containers such that they can be manufactured with higher productivity.

DISCLOSURE OF THE INVENTION

It is a primary object of the present invention to provide a pinch grip type bottle-shaped container capable of being readily released from the mold after the molding process, to thereby eliminate the above-mentioned problem.

To this end, the present invention provides a pinch grip type bottle-shaped container having opposed finger-receiving recesses, which are formed at sidewall regions of a container main body part, respectively, to thereby form a grip part of the container by the entire region including the recesses and a back surface region of the body part between the recesses, wherein the container is provided, at bottom surfaces of the finger-receiving recesses, with multiple projections projecting inwardly or outwardly of the container, respectively.

In the bottle-shaped container according to the present invention, the bottom surfaces of the finger-receiving recesses are provided with the multiple projections, respectively, thereby facilitating formation of a space between the applied resin and the mold so that the container can be readily released from the mold after the molding process, to improve the work efficiency upon manufacturing and thereby realize a higher productivity. Additionally, the ribs of the container after the molding process function as slip stoppers, thereby advantageously realizing a container that can be gripped readily and stably. Further, even when the container is thin-walled by reducing the used amount of resin so as to reduce the weight of the container, it is possible to ensure sufficient strength of the container and, in particular, sufficient rigidity at the sub-recesses recesses to be touched and held by fingers, thereby allowing the initial shape of the container to be stably retained.

In the bottle-shaped container according to the present invention, it is preferred that the projections comprise ribs that are arranged in parallel alignment with each other. In this case, it is possible to further improve the mold-releasability of the container after the molding process, thereby enabling a further improved productivity.

BRIEF DESCRIPTION OF THE DRAWINGS

The present invention will be described in further detail hereinafter, with reference to a preferred embodiment shown in the drawings.

BEST MODE FOR CARRYING OUT THE INVENTION

Figure 1:
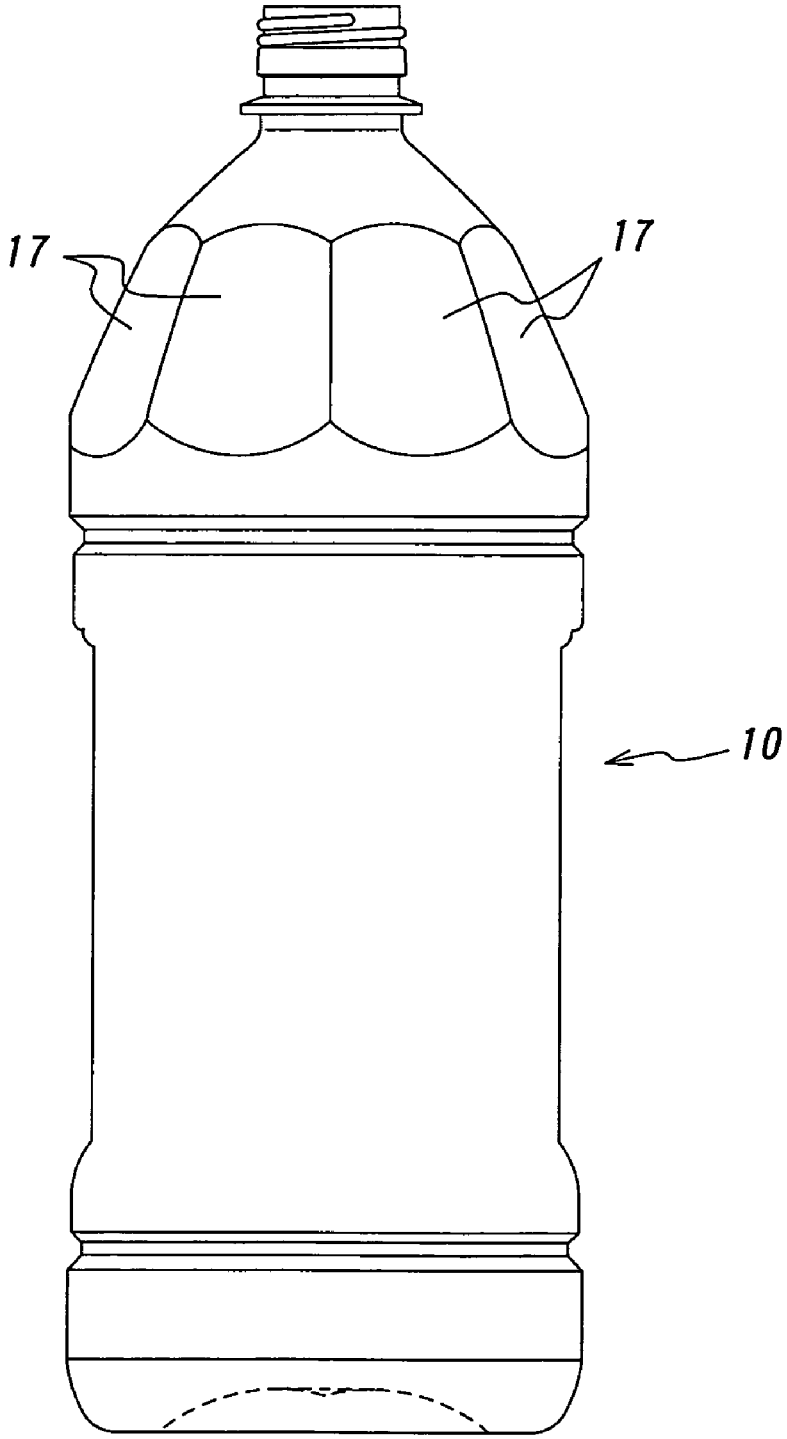
FIG. 1 through FIG. 3 are front view, side view and rear view, respectively, of a bottle-shaped container according to one embodiment of the present invention.
Figure 2:
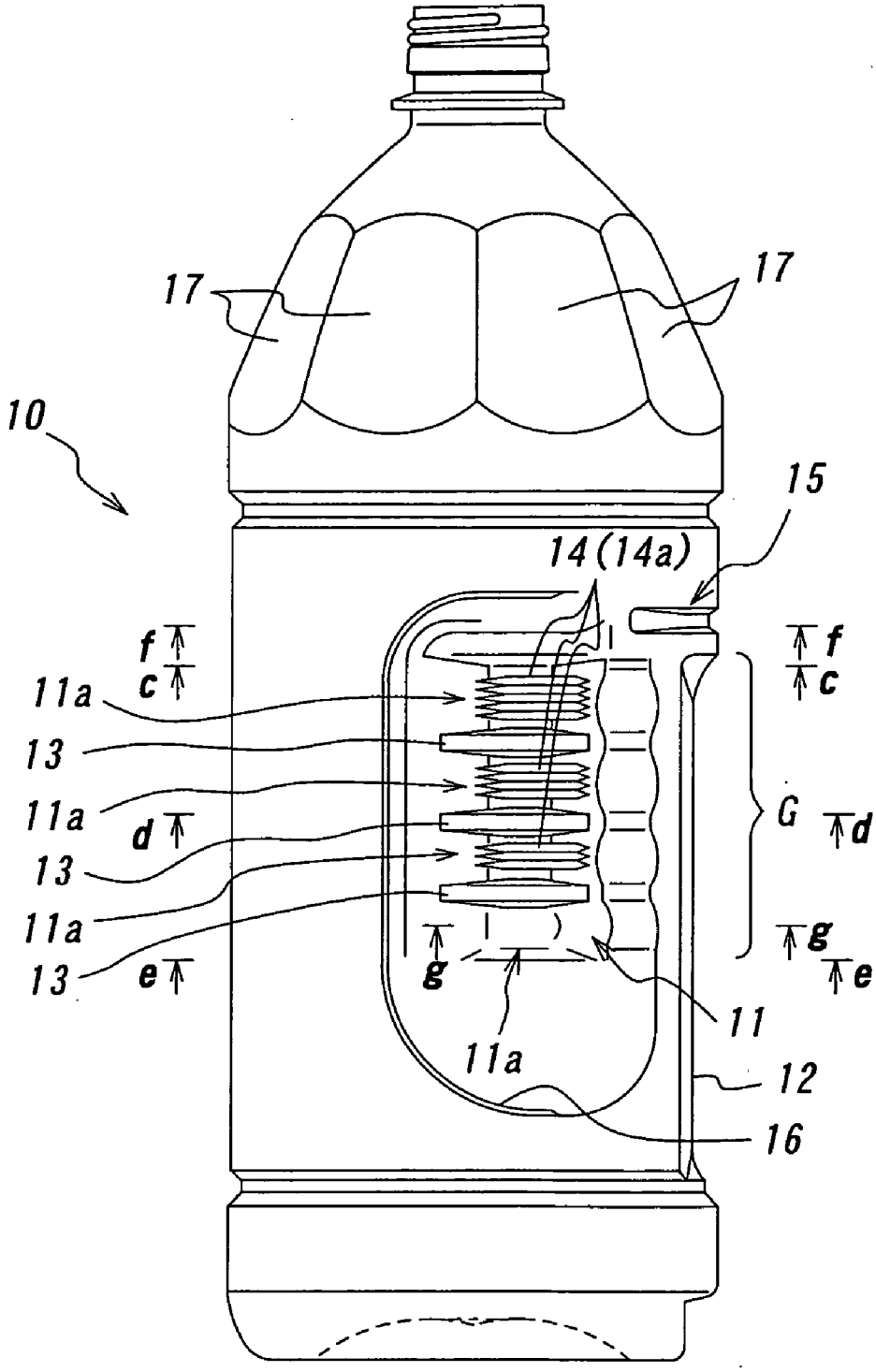
Figure 3:
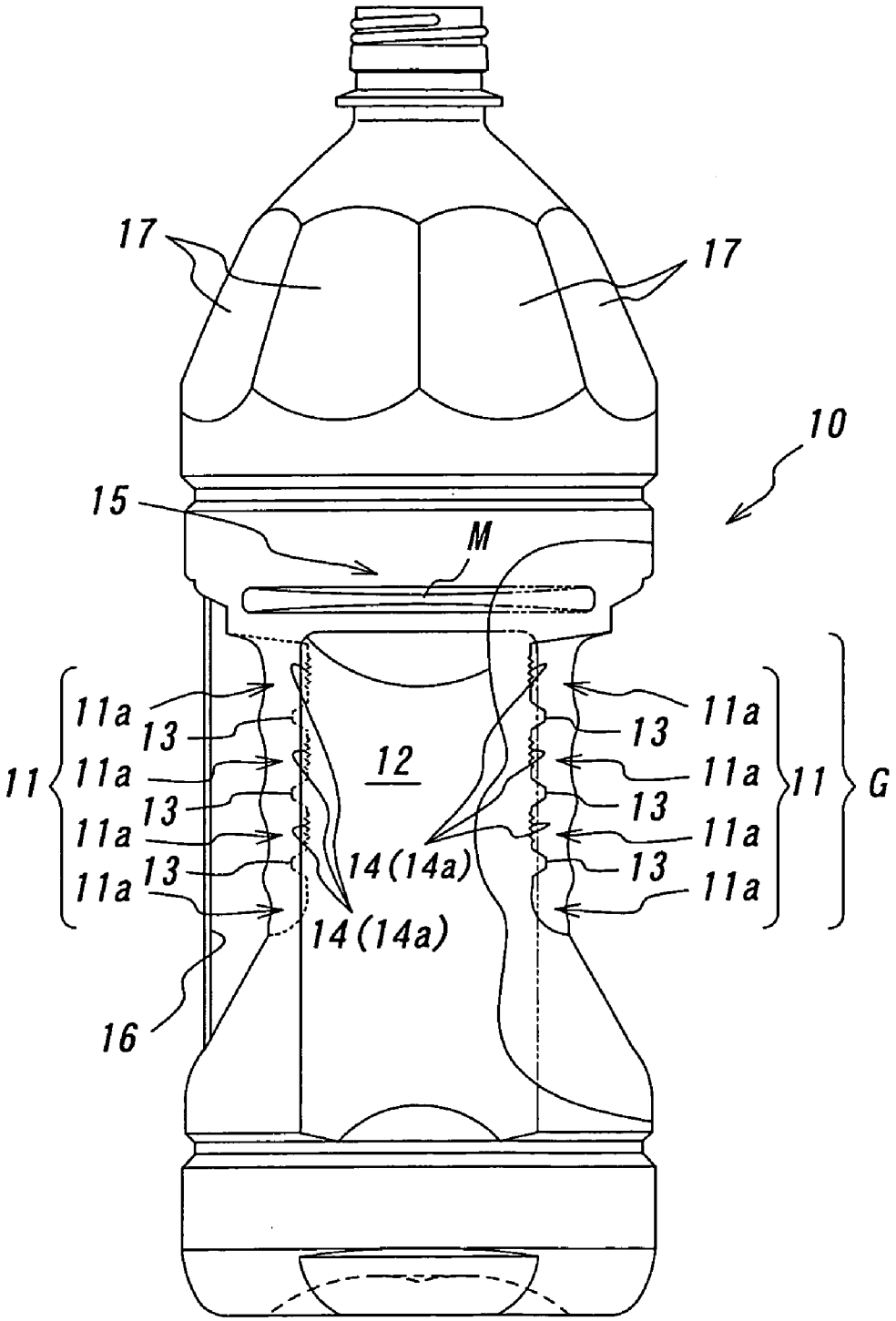

In FIGS. 1 through 3, reference numeral 10 designates a pinch grip type bottle-shaped container of a kind widely used as one having a filling volume of 2.7 liters. Reference numerals 11 designate recesses formed in sidewall regions of the container main body part in mutually opposed orientations, respectively, and reference numeral 12 designates a pressure-reduction compensating panel provided in the back surface region between the recesses 11 for preventing shape deformation of the container as a result of pressure drop within the container. There is formed a grip part G for gripping the container, by the entire region from one recess 11 to the other recess 11, including these recesses themselves and the pressure-reduction compensating panel 2.

Each of the regions near the body part of the bottle-shaped container 10 is reinforced by three reinforcing ribs 13 which extend in parallel with each other along a circumferential direction of the body part. The grouped three reinforcing ribs 13 divide the associated recess 11 into four sub-recesses 11*a*. These sub-recesses 11*a* are used as portions for engagement by user's fingers so as to grip the body part. Three of the associated four sub-recesses 11*a* to be engaged and held by fingers are provided, at the bottom surfaces thereof, with multiple projections 14, respectively, extending in parallel with each other along the circumferential direction of the body part. These projections, in turn, are each constituted as a rib group comprising a plurality of ribs 14*a*.

Reference numeral 15 designates a lateral rib having a groove M located at a boundary between an upper end of the pressure-reduction compensating panel 12 and the container main body part so as to project inwardly of the container, reference numerals 16 designate steps provided along the edges of the recesses 11 forming the grip part G, respectively, and reference numerals 17 designate pressure-reduction compensating panels, respectively, provided at the shoulder part of the container main body.

Figure 4:
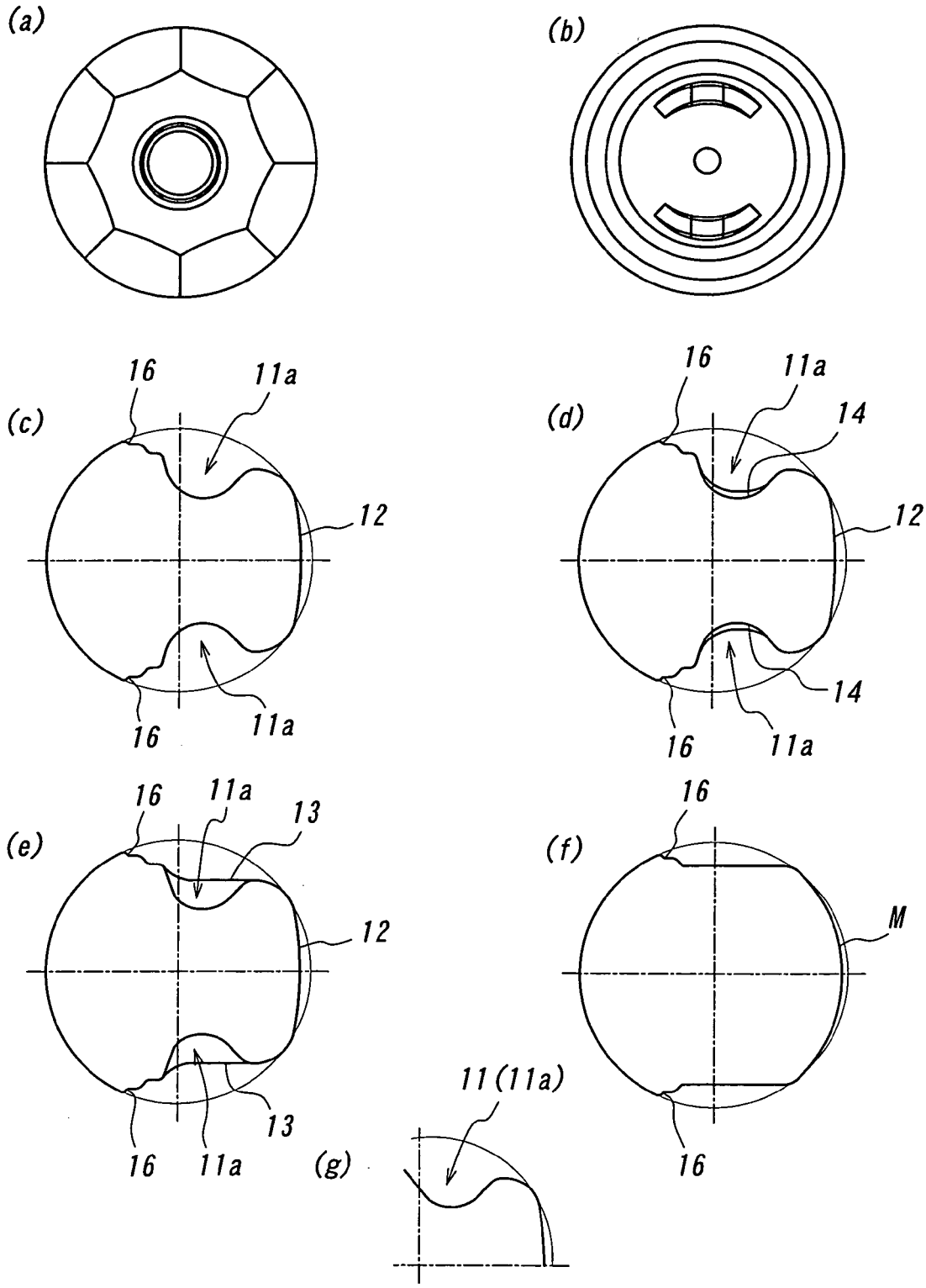
FIG. 4(*a*) and FIG. 4(*b*) are plan view and bottom view of the container of FIGS. 1 through 3, respectively, and FIGS. 4(*c*) through (*g*) are cross-sectional views taken along line c—c through line g—g of FIG. 2, respectively.

The transition of cross-sectional shape of the bottle-shaped container according to the above-mentioned embodiment is shown in FIGS. 4(*a*) through (*g*).

The present inventors have compared the container according to the present invention having the multiple ribs 14*a* provided at the bottom surfaces of the recesses to be held by fingers, respectively, with a container according to a comparative example in terms of mold-releasability after the blow molding process. As a result, it has been confirmed that the container according to the present invention can be readily released from the mold without any situation where the releasing is obstructed, whereas the releasing of the container according to the comparative example from the mold has been occasionally obstructed. It is considered that this is due to the fact that a space can be readily formed between the applied resin and the mold, by virtue of the multiple ribs 14*a* at the bottom surfaces of the recesses to be held by fingers, respectively.

In the bottle-shaped container 10 according to the above-mentioned embodiment, each rib group 14 is provided at the bottom surface of the associated one of the sub-recesses 11*a* obtained by dividing the recesses 11 for engagement by fingers, by means of the reinforcing ribs 13. Thus, the container 10 can be readily released from the mold after the blow molding process, thereby improving the working efficiency upon manufacture to realize higher productivity. Additionally, the rib groups 14 of the bottle-shaped container 10 after the molding process function as slip stoppers, thereby advantageously realizing a container that can be readily gripped. Furthermore, even when the container is thin-walled by reducing the used amount of resin so as to reduce the weight of the container, it is possible to ensure a sufficient strength of the container and, in particular, sufficient rigidity at the sub-recesses 11*a* that can be touched and held by fingers, thereby allowing the initial shape of the container to be stably retained.

In the bottle-shaped container 10 according to the above-mentioned embodiment, the rib groups 14 are preferably oriented in parallel alignment with each other, as shown in FIG. 2. In this instance, the container 10 can be more readily released from the mold after the blow molding process, thereby enabling a further improved productivity. It should be noted that the rib groups 14 are not limited to those which extend in parallel with each other along the circumferential direction of the body part, insofar as they are oriented in parallel alignment with each other, and the rib groups 14 may include those which extend in a direction inclined to, or in a longitudinal direction perpendicular to, the circumferential direction of the body part.

The present invention is not limited to the above-mentioned preferred embodiment, and can be of course embodied in many variants. For example, the projections 14 comprising the rib groups, respectively, may be provided not only at the three sub-recesses 11*a* to be engaged by fore-finger (thumb), middle finger and third finger which are capable of applying strong forces, but at all of the sub-recesses 11*a*. Similarly, the projection 14 may be provided over the entirety of the bottom surface of the associated recess 11, by directly using the recess 11 as a recess to be held by fingers, without dividing the recess 11 into sub-recesses 11*a* by the reinforcing ribs 13. Furthermore, each projection 14 may be constituted of multiple grooves (groove group) projected inwardly of the container, instead of the multiple ribs projected outwardly of the container.

Although the container according to the present invention can be molded by biaxial-stretching blow molding a thermoplastic resin, such as polyethylene terephthalate, the molding process is not particularly limited thereto. Also, the filling volume of the bottle-shaped container is not limited to 2.7 liters, and it is possible to variously adopt a bottle having a filling volume exceeding 2.7 liters or smaller filling volumes such as 1.8 liters, 1 liter, 500 milliliters or 350 milliliters.

The invention claimed is:

1. A pinch grip type bottle-shaped container, comprising:

mutually opposed recesses formed in sidewall regions of the container, and a pressure-reduction compensating panel provided in a back surface region of the container between the recesses, wherein each of the recesses is reinforced by a plurality of reinforcing ribs which extend in parallel with each other along a circumferential direction of the main body part of the container thereby dividing the recesses into a plurality of sub-recesses that provide engaging portions for a user's fingers to grip the main body part, and each of the plurality of sub-recesses are provided at bottom surfaces thereof with multiple projections extending in parallel with each other along the circumferential direction of the main body part, the projections extending in parallel with each other along the circumferential direction of the main body part, the multiple projections in each sub-recess comprising a rib group, the presence of these rib groups facilitating releasability of a manufactured container from a mold in which the container is manufactured.

* * * * *